US006478183B1

(12) United States Patent
Bacon et al.

(10) Patent No.: US 6,478,183 B1
(45) Date of Patent: Nov. 12, 2002

(54) LIGHTWEIGHT OVERCAP HAVING INTERMITTENT NESTING AND STACKING ELEMENTS

(75) Inventors: John C. Bacon, Hartsville, SC (US); Adrienne N. Lynn, Florence, SC (US); Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/843,762

(22) Filed: Apr. 27, 2001

(51) Int. Cl.[7] ..... B65D 43/03

(52) U.S. Cl. ..... 220/784; 206/511; 206/508; 220/380; 220/782; 220/694; 220/256.1

(58) Field of Search ..... 206/503, 508, 206/509, 511, 505; 220/380, 781, 782, 784, FOR 100, 256.1, 694

(56) References Cited

U.S. PATENT DOCUMENTS

| | | | | | |
|---|---|---|---|---|---|
| 3,070,257 | A | * | 12/1962 | Bojanowski | 206/508 |
| 3,128,903 | A | | 4/1964 | Crisci | |
| 3,163,318 | A | | 12/1964 | Frank | |
| 3,179,283 | A | | 4/1965 | Amberg | |
| 3,237,800 | A | * | 3/1966 | Edwards | 206/508 |
| 3,353,708 | A | * | 11/1967 | Davis | 220/784 |
| 3,372,834 | A | | 3/1968 | Ayotte et al. | |
| 3,474,928 | A | * | 10/1969 | Hurtt | 206/508 |
| 3,510,023 | A | * | 5/1970 | Ullman et al. | 220/320 |
| 3,519,163 | A | * | 7/1970 | Bardell | 206/508 |
| 3,567,064 | A | * | 3/1971 | Churan | 220/256.1 |
| 3,589,552 | A | * | 6/1971 | Fitzgerald et al. | 220/380 |
| 3,677,435 | A | * | 7/1972 | Davis | 206/519 |
| 3,722,731 | A | * | 3/1973 | McCormick et al. | 206/509 |
| 3,739,976 | A | | 6/1973 | MacDaniel | |
| 3,946,897 | A | * | 3/1976 | Wolff | 206/503 |
| 3,956,550 | A | * | 5/1976 | Sutch | 156/242 |
| 4,026,459 | A | | 5/1977 | Blanchard | |
| 4,042,143 | A | * | 8/1977 | Biggins | 220/780 |
| 4,076,123 | A | * | 2/1978 | Davis | 206/503 |
| 4,117,950 | A | * | 10/1978 | Allen | 220/782 |
| 4,235,349 | A | * | 11/1980 | Uhlig | 220/792 |
| 4,252,265 | A | * | 2/1981 | Brundige et al. | 206/508 |
| 4,256,240 | A | * | 3/1981 | Woinarski | 206/508 |
| 4,305,535 | A | | 12/1981 | Brundige et al. | |
| 4,307,817 | A | * | 12/1981 | Cotroneo | 220/789 |
| 4,397,404 | A | * | 8/1983 | Blanchette | 206/508 |
| 4,512,493 | A | * | 4/1985 | Von Holdt | 206/505 |
| 4,702,389 | A | * | 10/1987 | Bozinovich et al. | 206/508 |
| 4,718,571 | A | * | 1/1988 | Bordner | 206/508 |
| 4,779,754 | A | | 10/1988 | Ten Eyck et al. | |
| 4,817,801 | A | * | 4/1989 | Schwaikert | 206/508 |
| 4,836,407 | A | * | 6/1989 | Bruce et al. | 220/276 |
| 4,886,184 | A | * | 12/1989 | Chamourian | 206/508 |
| 4,892,213 | A | * | 1/1990 | Mason, Jr. | 206/508 |
| 5,105,964 | A | | 4/1992 | Heath | |
| 5,381,918 | A | * | 1/1995 | Dahl | 206/508 |
| 5,540,349 | A | | 7/1996 | Philips | |
| 5,791,509 | A | * | 8/1998 | Rush et al. | 206/508 |
| 5,897,015 | A | | 4/1999 | Sheahan | |
| 6,068,154 | A | * | 5/2000 | Grabher | 220/782 |

* cited by examiner

*Primary Examiner*—Lee Young
*Assistant Examiner*—Robin Hylton
(74) *Attorney, Agent, or Firm*—Bullwinkel Partner, Ltd.

(57) ABSTRACT

A lightweight overcap for a cylindrical container that requires substantially less material. The material savings is realized by the use of thinner walls and intermittent closure, nesting and stacking structures.

8 Claims, 5 Drawing Sheets

LIGHTWEIGHT OVERCAP HAVING INTERMITTENT NESTING AND STACKING ELEMENTS

BACKGROUND OF THE INVENTION

1. Field of the Invention

This invention relates to overcaps for containers, and more particularly to an overcap for beaded, stackable containers that is significantly lighter than conventional overcaps.

2. Description of the Related Art

Plastic overcaps, typically made of low density polyethylene (LDPE), are commonly used to reclose the open end of cylindrical containers used for holding items such as snacks, drink mixes, coffee and shortening. Such overcaps protect the contents of the container from contamination but do not provide an oxygen barrier and are not airtight.

Overcaps generally have a planar covering portion and a sidewall extending downward from the periphery of the covering portion. A vertex juts inwardly from the interior of the sidewall to engage the underside of the lip of a container. To open the container, the user lifts up and out on the lower edge of the sidewall, thereby disengaging the vertex from the lip.

Overcaps sometimes have a nesting ring projecting upwardly from the planar covering portion of the overcap near its circumference and a depressed ledge extending outward from the nesting ring. The nesting ring and ledge cooperate to hold a second overcap placed on top so that a number of overcaps can be held in stacked fashion. The stack of overcaps can be picked up by machine and placed in a shipping box.

Some conventional overcaps also have a stacking ring or lug projecting upwardly from the planar covering portion of the overcap, concentric with the nesting ring but having a smaller diameter. The stacking lug seats within the recessed end of the bottom of a second container to maintain the second container in stacked alignment with the first container.

While such conventional overcaps are suited for their particular purpose, there nevertheless is a need for an overcap that performs the same functions but uses less material. The present invention fulfills this need by providing an overcap having an intermittent nesting ring and stacking lug, intermittent vertex, and thinner walls than conventional overcaps.

Therefore it is an object of the present invention to provide an overcap for stackable containers that is lighter weight and requires significantly less material than conventional overcaps.

Another object of the invention is to provide a lightweight overcap that retains the sturdy feel of heavier overcaps.

Further and additional objects will appear from the description and accompanying drawings.

BRIEF SUMMARY OF THE INVENTION

The present invention is an overcap for a beaded cylindrical container that is significantly lighter than conventional overcaps. The lightweight overcap comprises a substantially planar covering portion, a sidewall portion, intermittent locking detents for securing the overcap to the container, intermittent nesting segments for nesting a second overcap on top, and intermittent stacking lugs to seat the overcap within the recessed end of a second container stacked on top of the assembled overcap and container.

The covering portion has a circular flat central portion and a raised annular portion extending outwardly therefrom. The periphery of the annular portion forms a recessed nesting ledge for receiving a second overcap. The sidewall extends downwardly from the periphery of the annular portion.

The locking detents are evenly disposed about the inner surface of the sidewall and extend inwardly therefrom. The detents are adapted to fit under the beaded top of the container to secure the overcap to the container.

The intermittent nesting segments are longitudinally aligned and evenly disposed about the upper surface of the annular portion. The nesting segments are adapted to form a frictional fit with the inside of a similarly configured overcap to facilitate nesting of the overcaps during shipping and storage.

The intermittent stacking lugs are longitudinally aligned and evenly disposed about the upper surface of the annular portion, and are adapted to fit within the bottom of a similarly configured container to facilitate stacking of multiple containers with overcaps.

Preferably, the nesting segments and stacking lugs are staggered around the annular portion, meaning a line normal to the arc of the annular portion may intersect a nesting segment or a stacking lug, but not both. The detents preferably are aligned with the nesting segments.

In the preferred embodiment, the covering portion is about 0.013 inches thick and the sidewall is about 0.019 inches thick.

DETAILED DESCRIPTION OF THE INVENTION

Figure 1:
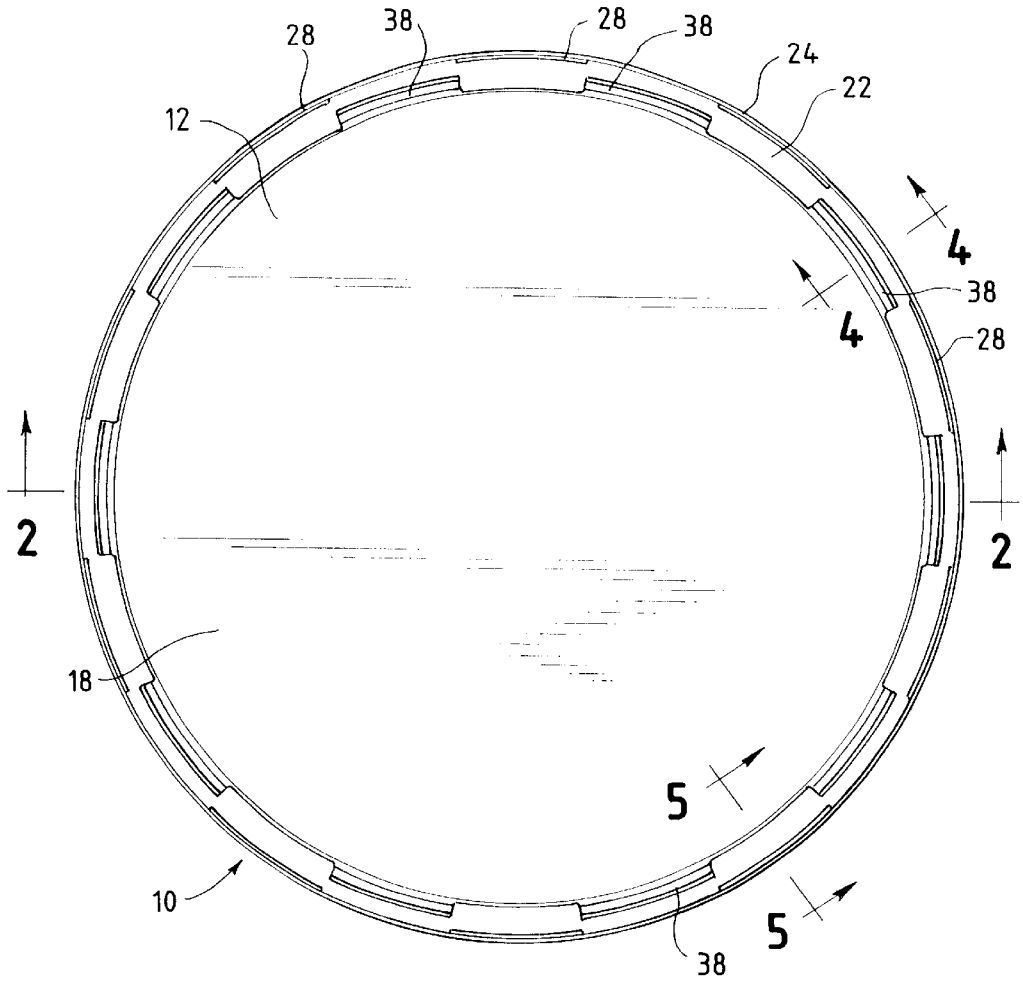
FIG. 1 is a top plan view of one embodiment of a lightweight overcap made according to the present invention.
Figure 2:
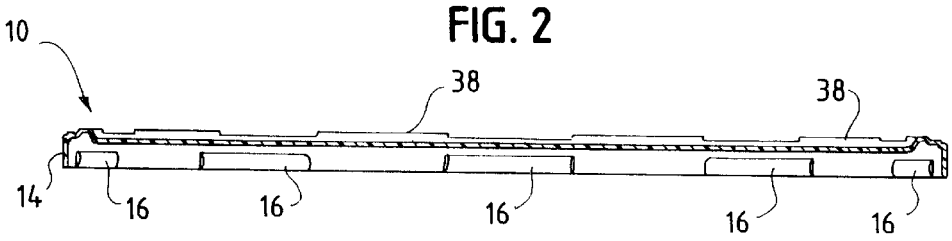
FIG. 2 is a cross-sectional view of the overcap of FIG. 1 taken along line 2—2.
Figure 4:
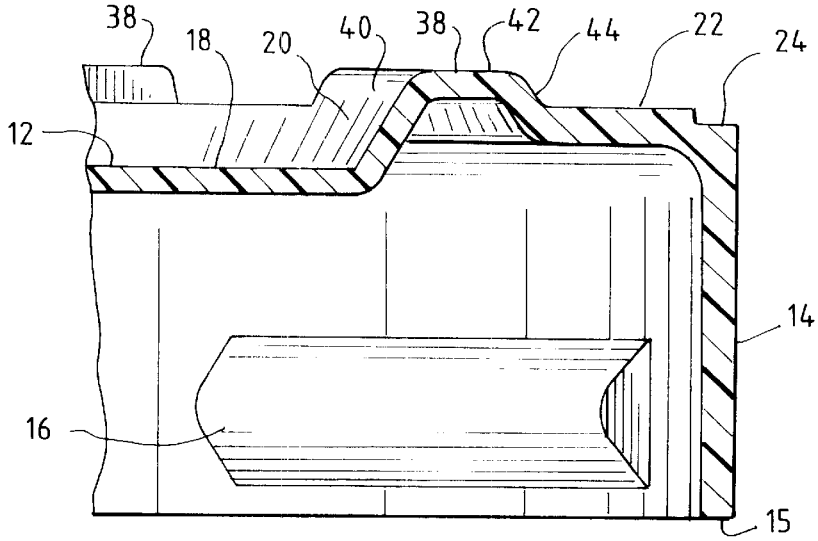
FIG. 4 is an enlarged, fragmentary cross-sectional view of the overcap of FIG. 1, taken along line 4—4.
Figure 9:
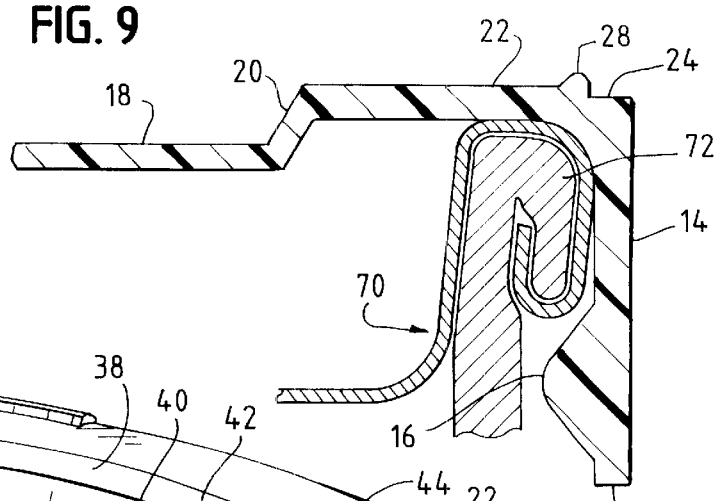
FIG. 9 is an enlarged, fragmentary cross-sectional view of a lightweight overcap shown covering the open end of a conventional container.

The present invention is a lightweight overcap for use with beaded, stackable containers used for holding items such as snacks, drink mixes, coffee and shortening. Referring to FIGS. 1 and 2, the overcap 10 comprises a substantially planar top covering portion 12 and a sidewall 14. As best shown in FIG. 4, a vertex or detent 16 extends inwardly from the interior of the sidewall 14 to engage the beaded top 72 of a container 70 (FIG. 9).

Figure 8:
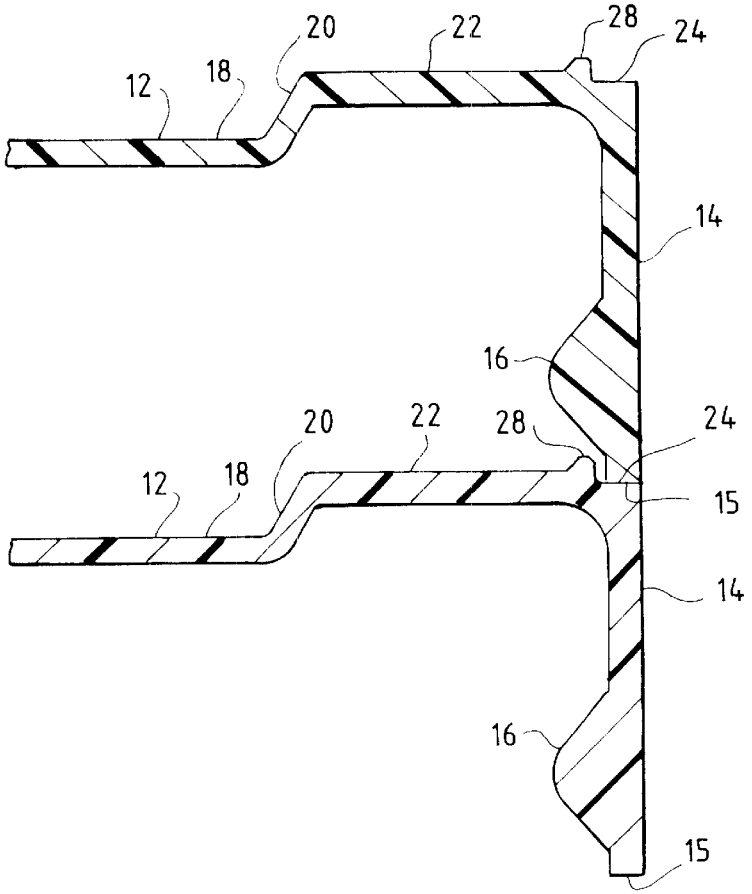
FIG. 8 is an enlarged, fragmentary cross-sectional view of two lightweight overcaps made according to the present invention and nested together.
Figure 10:
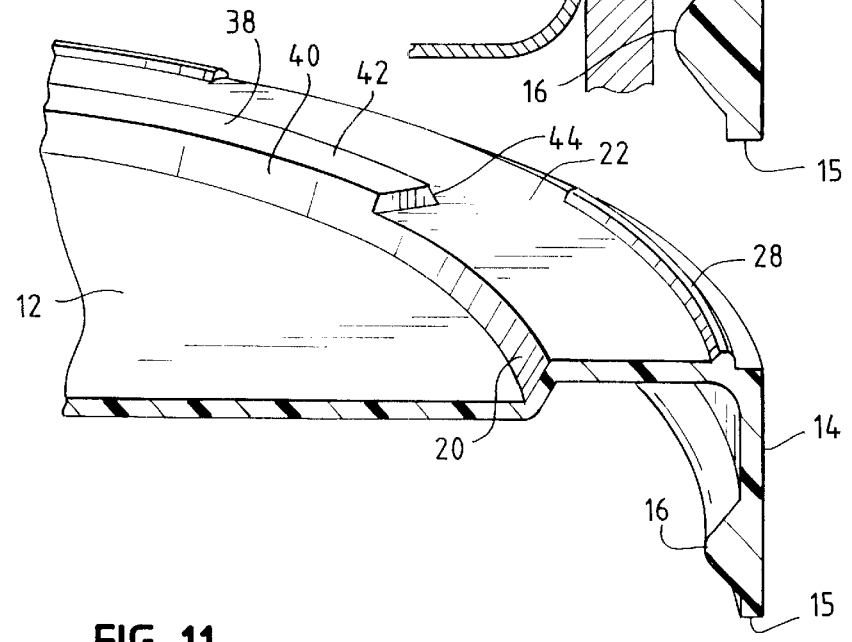
FIG. 10 is an enlarged cutaway perspective view of the overcap of FIG. 1.

As shown in FIGS. 1, 8 and 10, the top covering portion 12 comprises a circular flat central portion 18, an angled wall portion 20 extending upwardly and outwardly from the central portion 18, a raised annular portion 22 extending outwardly therefrom, and a slightly recessed nesting ledge 24 extending circumferentially around the raised annular portion 22. The preferred angle defined by the central portion 18 and the flared wall portion 20 is about sixty degrees. The sidewall 14 extends downwardly from the periphery of the top portion 12.

Figure 3:
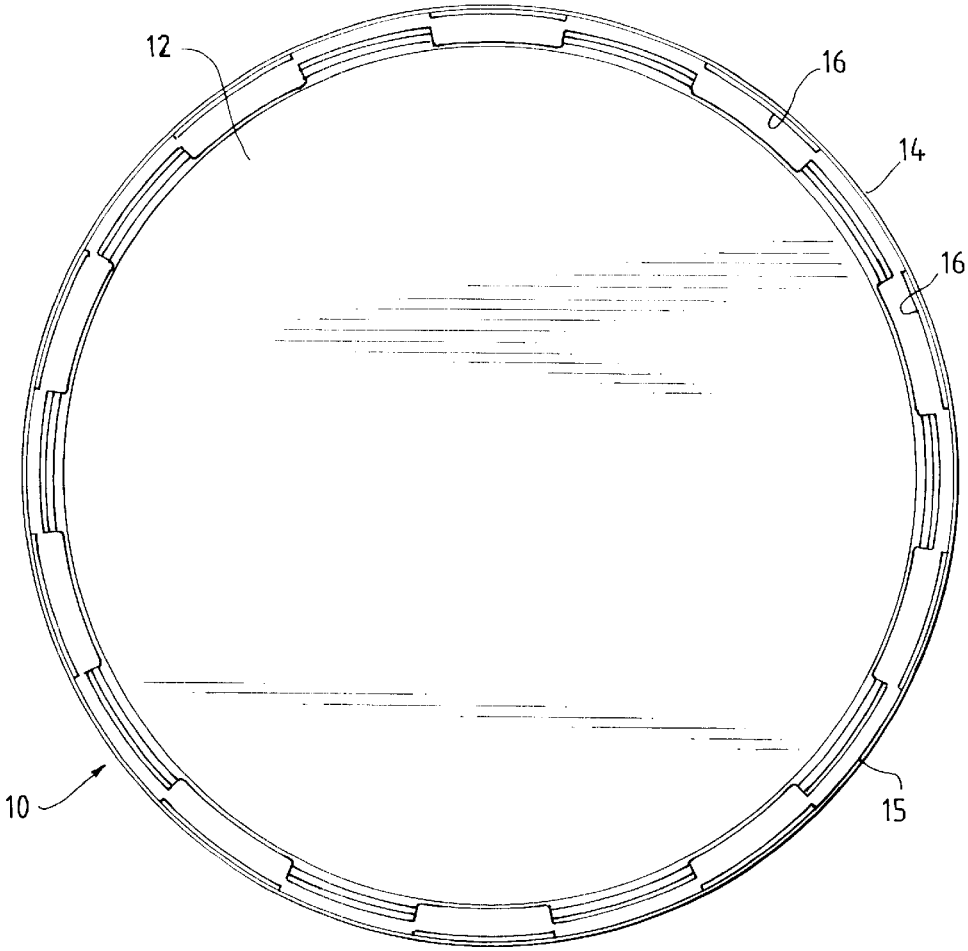
FIG. 3 is a bottom plan view of the overcap of FIG. 1.

As shown in FIGS. 2 and 3, the vertex 16 is interrupted, i.e., not continuous. Each segment 16 of the vertex may be referred to as a detent, each detent 16 being similar to a tab that engages the underside of the container bead. Preferably, the detents 16 are evenly disposed about the inner surface of the sidewall 14 and extend inwardly therefrom.

Disposed around the top surface of the annular portion 22 is a nesting ring 28. The nesting ring 28 is also segmented. The intermittent nesting segments 28 are arcuately shaped and evenly disposed about the upper surface of the raised annular portion 22, and are configured to form a frictional fit with the inside surface of the sidewall of a similarly configured overcap to facilitate nesting of the overcaps during shipping and storage (FIG. 8). When nested, the ledge 24 of the overcap 10 receives the bottom edge 15 of a second identical overcap.

Figure 6:
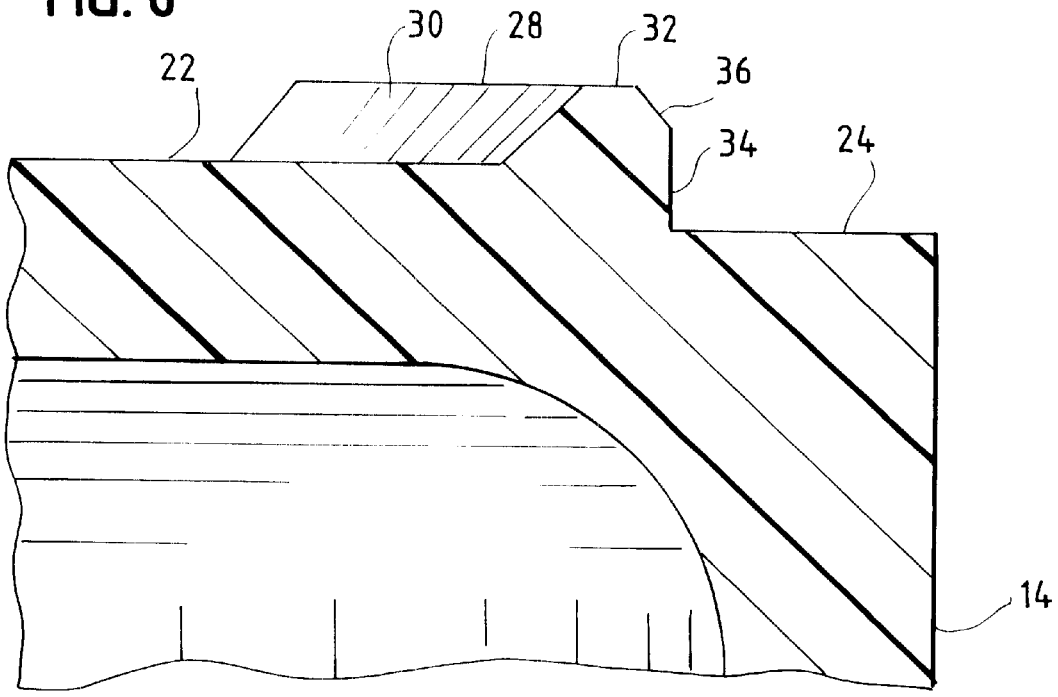
FIG. 6 is a greatly enlarged view of a portion of FIG. 5, showing the intermittent nesting ring in greater detail.

As best shown in FIG. 6, each nesting segment 28 comprises an inwardly angled inner wall 30, a top surface 32, a vertical outer wall 34 and a beveled edge 36 extending between the top surface 32 and the vertical outer wall 34. The beveled edge 36 facilitates nesting of multiple overcaps by guiding the sidewall 14 of one overcap onto the nesting ledge 24 of another overcap.

Figure 7:
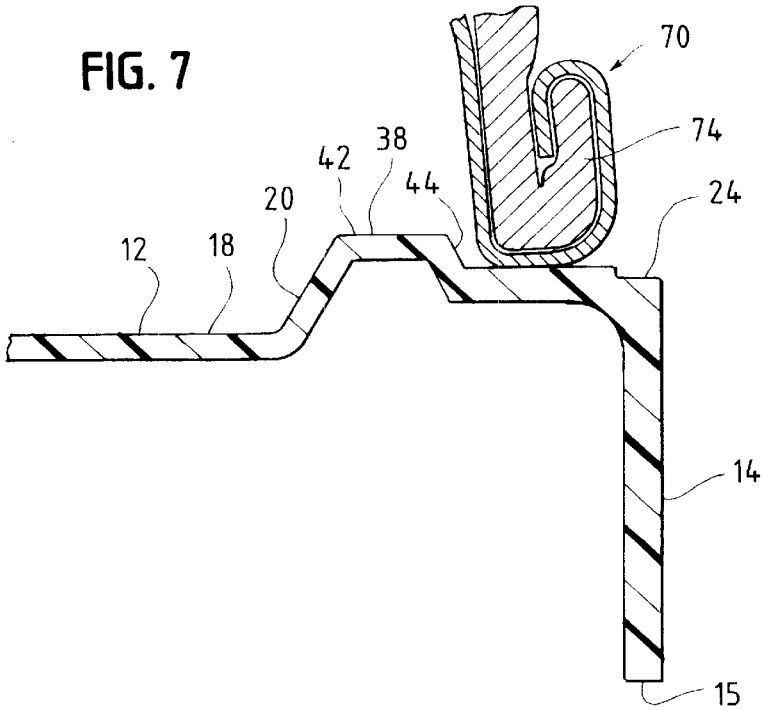
FIG. 7 is an enlarged, fragmentary cross-sectional view of an overcap according to FIG. 1 and the bottom rim of a container positioned on top of the overcap.

As shown in FIGS. 1, 7 and 10, a stacking ring 38 is also disposed around the top surface of the annular portion. The stacking ring 38 is also intermittent, forming multiple intermittent arcuately shaped stacking lugs 38 longitudinally aligned and evenly disposed about the upper surface of the annular portion 22. The stacking lugs 38 are adapted to fit within the bottom edge 74 of a similarly configured container 70 to facilitate stacking of multiple containers with overcaps.

Figure 5:
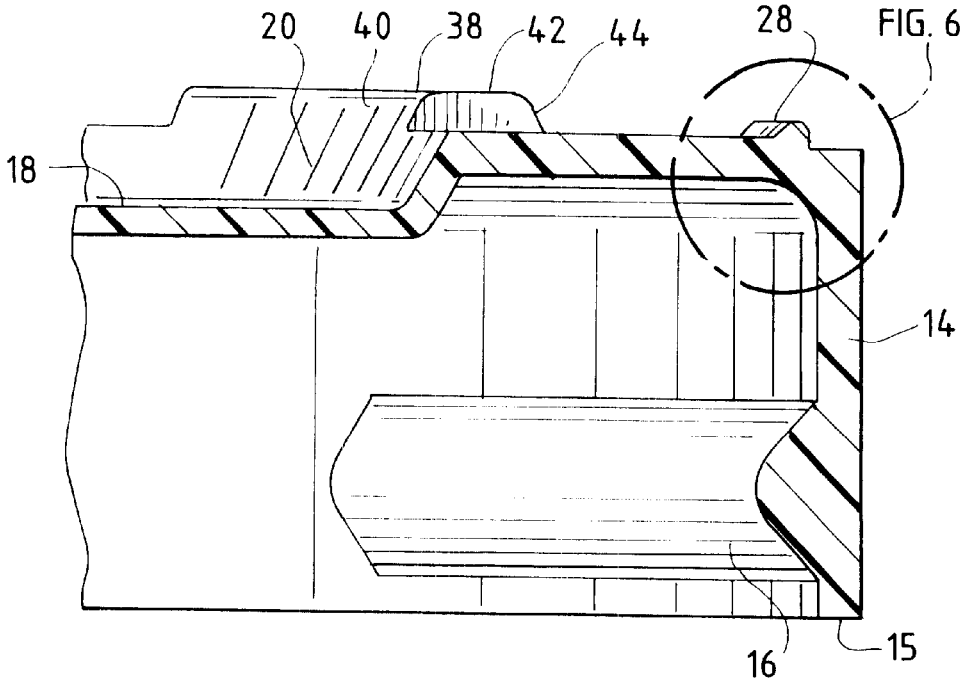
FIG. 5 is an enlarged, fragmentary cross sectional view of the overcap of FIG. 1, taken along line 5—5.

As best shown in FIGS. 5 and 10, the stacking lugs 38 comprise an inwardly angled inner wall 40, a top surface 42 and an outwardly angled outer wall 44. Preferably, the inner wall 40 is a continuation of the covering portion flared wall 20. The preferred vertical dimension of the stacking lugs 38, measured from the top surface of the annular portion 22, is 0.013 inches.

In the preferred embodiment shown in FIGS. 1–10, the nesting ring segments 28 and the stacking lugs 38 are staggered about the annular portion, meaning a line normal to the arc of the annular portion may intersect a nesting segment or a stacking lug, but not both. The detents 16 preferably are coextensive with the nesting ring segments 28. Thus, line 4—4 of FIG. 1 passes through a stacking lug 38 but not a detent 16 or a nesting segment 28, while line 5—5 passes through a detent 16 and a nesting segment 28 but not a stacking lug 38.

Conventional overcaps come in many shapes and sizes. Usually the sidewall thickness ranges from about 0.026 inches to 0.036 inches and the top wall thickness ranges from about 0.020 inches to 0.046 inches. By contrast, the sidewalls 14 of the present invention are a mere 0.019 inches thick and the central covering portion 18 is only 0.013 inches thick, resulting in a savings of material, although these dimensions can be varied according to the application. Additional savings of material is realized by making the vertex, nesting ring and stacking lug intermittent. The present invention decreases up to 30% the amount of material required for a typical overcap, yet the savings in material is intended to be transparent to the consumer.

Figure 11:
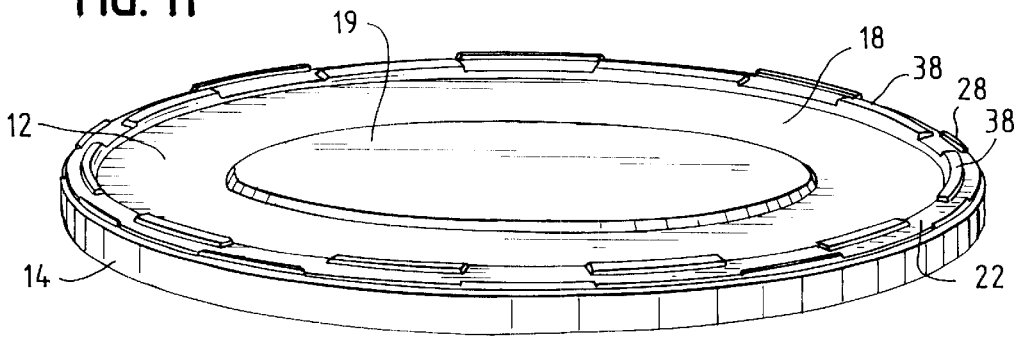
FIG. 11 is a top perspective view of an alternative embodiment of a lightweight overcap made according to the present invention with an integrally formed reinforcing stepped portion.
Figure 12:
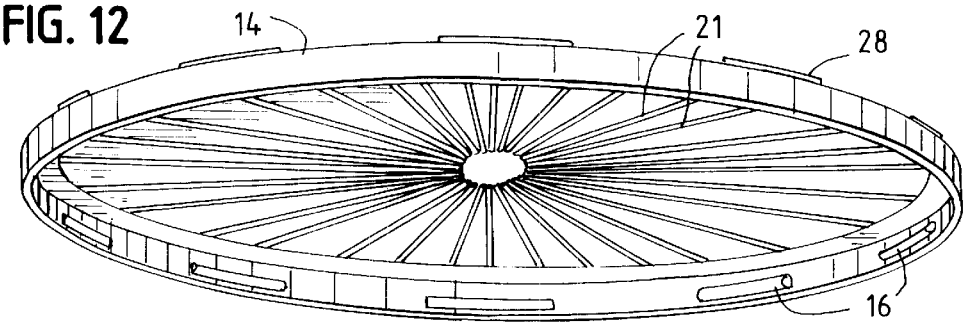
FIG. 12 is a bottom perspective view of an alternative embodiment of a lightweight overcap made according to the present invention with integrally formed reinforcing ribs.

Reinforcing structures may be integrally formed into the overcap central portion 18 to increase the rigidity of the overcap, giving the lightweight overcap an even more "normal" feel to the consumer and allowing for improved automated handling. Examples of such reinforcing structures include one or more concentric stepped portions 19 as shown in FIG. 11 and radially extending ribs 21 as shown in FIG. 12. The stepped portions preferably have a truncated cone shape and rise from the center of the central portion 18. Where more than one stepped portion is incorporated into the overcap design, one or more stepped portions may be set below the plane of the center panel so that the total height of the stepped portions does not extend above the normal unreinforced height of the overcap.

Thus there is provided a lightweight overcap that decreases the amount of required material by up to 30% compared to conventional overcaps, resulting in a substantial cost savings in raw materials. The overcap can be used with composite, metal or plastic containers.

Other embodiments of the invention are contemplated which do not depart from the scope of the invention claimed. While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

We claim as our invention:

1. A lightweight overcap for a cylindrical container, said container having a beaded top and a closed bottom, said overcap comprising:

a substantially planar covering portion having a flat central portion and a raised annular portion extending outwardly therefrom, said annular portion having an upper surface;

a sidewall extending downwardly from the periphery of the raised annular portion and having an inner surface;

intermittent arcuate shaped stacking lugs evenly disposed about the upper surface of the annular portion, said lugs aligned in a ring adapted to form a close fit with the bottom edge of a similarly configured container to facilitate stacking of containers with overcaps;

intermittent, arcuate shaped nesting segments evenly disposed about the upper surface of the annular portion, said segments aligned longitudinally in a ring adapted to form a close fit with the inside of a similarly configured overcap to facilitate nesting of overcaps, the nesting ring and the stacking ring having different diameters; and locking detents evenly disposed about the inner surface of the sidewall and extending inwardly therefrom, said detents adapted to form a snap fit with the beaded top of the container to secure the overcap to the container.

2. The lightweight overcap of claim 1 wherein the stacking lugs and nesting segments are staggered such that a line normal to the annular ring cannot intersect a stacking lug and a nesting segment.

3. The lightweight overcap of claim 2 wherein the detents are substantially vertically aligned with the nesting segments.

4. The lightweight overcap of claim 1 wherein the covering portion is about 0.013 inches thick and the sidewall is about 0.019 inches thick.

5. The lightweight overcap of claim 1 wherein the central portion comprises means for increasing the rigidity of the center panel.

6. The lightweight overcap of claim 5 in which the means for increasing the rigidity of the central portion comprises a raised circular stepped portion.

7. The lightweight overcap of claim 6 in which the stepped portion is shaped like a truncated cone.

8. The lightweight overcap of claim 5 in which the means for increasing the rigidity of the central portion comprises radially extending ribs.

* * * * *